United States Patent [19]

Bills

[11] 4,081,021

[45] Mar. 28, 1978

[54] SEMI-CONTINUOUS DIRECT CHILL CASTING APPARATUS

[75] Inventor: Reed G. Bills, Glendale, Ariz.

[73] Assignee: Reynolds Metals Company, Richmond, Va.

[21] Appl. No.: 648,734

[22] Filed: Jan. 13, 1976

[51] Int. Cl.[2] ..... B22D 11/00

[52] U.S. Cl. ..... 164/154; 164/425; 187/29 A

[58] Field of Search ..... 164/274, 282, 154, 82; 91/435; 73/507; 187/26, 29 A

[56] References Cited

U.S. PATENT DOCUMENTS

| | | | |
|---|---|---|---|
| 404,726 | 6/1889 | Nickerson | 91/435 |
| 1,741,833 | 12/1929 | Ferris | 73/507 X |
| 3,187,844 | 6/1965 | MacNair et al. | 187/29 A |
| 3,667,534 | 6/1972 | Kanokogi et al. | 164/83 |
| 3,977,497 | 8/1976 | McMurray | 187/29 A |

FOREIGN PATENT DOCUMENTS

| | | | |
|---|---|---|---|
| 240,288 | 8/1969 | U.S.S.R. | 91/435 |

*Primary Examiner*—Robert D. Baldwin

*Attorney, Agent, or Firm*—Glenn, Lyne, Gibbs & Clark

[57] ABSTRACT

Casting apparatus comprising means for feeding molten material, a mold receiving the molten material in which the molten material solidifies forming a casting advancing through the mold, a cylinder, means including a piston operable in the cylinder ahead of the advancing casting limiting the speed of advance of the casting, means including a fluid pressure system for controlling the speed of advance of the piston in the cylinder by differential pressure on opposite ends of the piston, a control device settable for the desired speed of advance of the piston, a signal device responsive to the actual speed of advance of the piston and connections between the control device and the signal device determining said differential pressure to insure maintenance of the speed of advance of the piston at the desired speed.

2 Claims, 4 Drawing Figures

SEMI-CONTINUOUS DIRECT CHILL CASTING APPARATUS

This invention relates to casting apparatus and more particularly to casting apparatus in which molten material is fed to and through a mold, the material freezing or solidifying as it advances, progressively forming an elongated casting whose cross section is determined by the mold. The invention relates still more particularly to control of the speed of progressive forming of the elongated casting. I provide for positive or automatic control of the speed of formation of the casting, supplanting manual or operator control.

My invention is applicable to what is commonly called semi-continuous casting of molten material which freezes or solidifies during casting. For purposes of explanation and illustration I shall describe the invention as applied to the semi-continuous direct chill casting of aluminum or alloys of aluminum, it being understood that the invention is also applicable to the casting of other non-ferrous metals, ferrous metals and nonmetallic materials such as plastics which may be formed in the molten state.

In the semi-continuous direct chill casting of aluminum it is important to the quality of the product that the casting speed be maintained constant at an optimum level. The casting speed is determined by the speed of advance of the platen which moves ahead of the progressively forming castings (normally a plurality of castings are formed side by side simultaneously). The speed of advance of the platen is limited by a piston operating in a cylinder, the piston being in advance of the platen and connected therewith by a piston rod. The speed of advance of the piston in the cylinder is controlled by a fluid (preferably hydraulic) pressure system. Factors such as oil viscosity, temperature, pressure and system leakage tend to affect optimum controlled piston advance. Heretofore manual or operator attempts to counteract such factors have not been fully satisfactory, to the detriment of the quality of the castings produced.

I provide for positive or automatic control of the speed of advance of the piston so that the casting speed is maintained constant at an optimum level, resulting in production of castings of high quality. Factors such as oil viscosity, temperature, pressure and system leakage are effectively nullified.

I provide casting apparatus comprising means for feeding molten material, a mold receiving the molten material in which the molten material solidifies forming a casting advancing through the mold, a cylinder, means including a piston operable in the cylinder ahead of the advancing casting limiting the speed of advance of the casting, means including a fluid pressure system for controlling the speed of advance of the piston in the cylinder by differential pressure on opposite ends of the piston, a control device settable for the desired speed of advance of the piston, a signal device responsive to the actual speed of advance of the piston and connections between the control device and the signal device determining said differential pressure to insure maintenance of the speed of advance of the piston at the desired speed.

Other details, objects and advantages of the invention will become apparent as the following description of certain present preferred embodiments thereof proceeds.

In the accompanying drawings I have shown certain present preferred embodiments of the invention in which FIG. 1 is a view partially in elevation and partially in vertical cross-section with portions cut away of casting apparatus embodying my invention;

Figure 1:
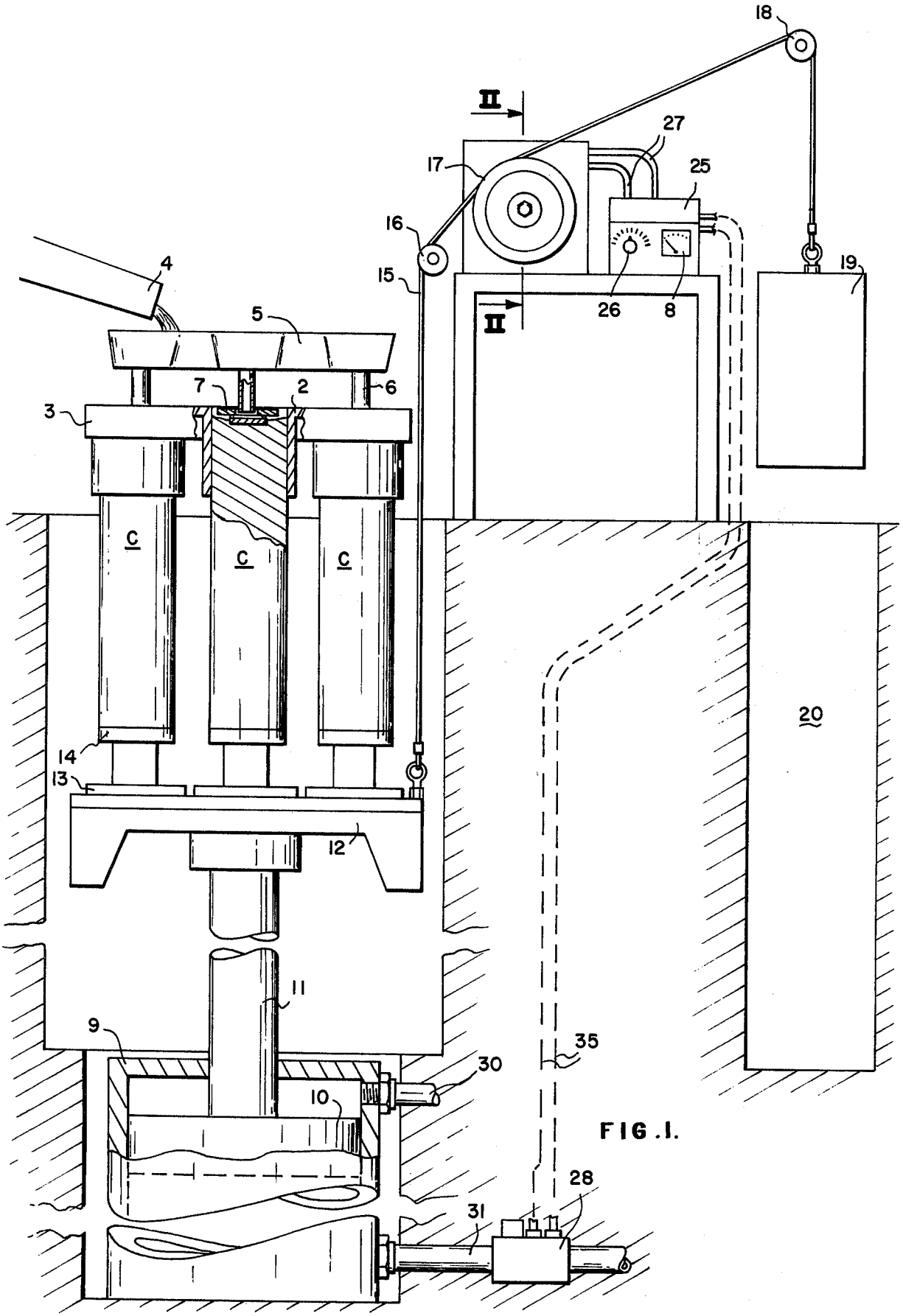
Figure 2:
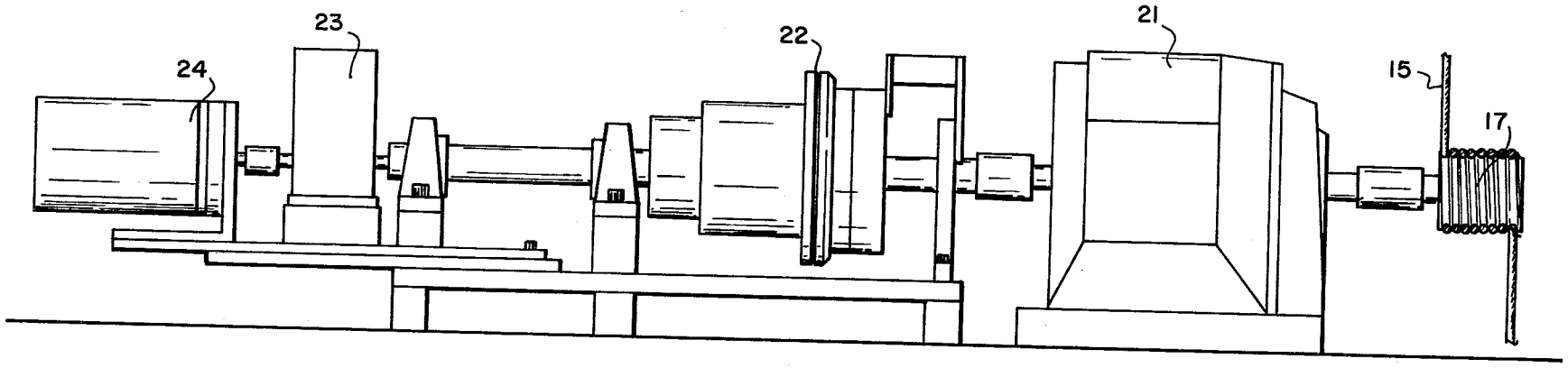
FIG. 2 is an enlarged elevational view of a portion of the casting apparatus shown in FIG. 1, taken on the line II—II of FIG. 1.

Referring now more particularly to the drawings and first to FIG. 1, my casting apparatus comprises a group of molds 2 mounted in a top plate 3 suitable supported in stationary position by means not shown as well known to those skilled in the art. Molten material such as aluminum or aluminum alloy is fed through a runner 4 into a tundish 5 and thence down through feeders 6 into the molds 2. A baffle 7 floats atop each incipient casting C.

Mounted below the center of the top plate 3 is a cylinder 9 in which operates a piston 10 having an upwardly extending piston rod 11 carrying a platen 12. The platen 12 carries a plurality of mold base stands 13 upon each of which is mounted a mold base 14, the arrangement being such that one of the mold bases 14 is in coaxial relationship with each of the molds 2.

At the beginning of the casting operation the piston 10 is at the top of its stroke in the cylinder 9 and the mold bases 14 are disposed within the respective molds 2. As the molten material is fed into the molds it is subjected to the action of a coolant such as water and freezes or solidifies in the molds. The piston 10 begins to move downwardly carrying the platen and the mold bases. The casting begins to form on each of the mold bases and as the downward movement of the mold bases and the feeding of molten material into the molds continues the castings grow progressively.

All that has been described thus far is conventional and well known to those skilled in the art. As indicated above, I provide novel means for insuring positively or automatically that the formation of the castings is carried out at uniform optimum speed despite fluctuation in oil viscosity, temperature and pressure and system leakage. I accomplish this new and useful result by the utilization in a novel combination of known control elements all of which are commercially available. The function individually of such commercially available elements is known to those skilled in the art so it is unnecessary to set forth herein the circuitry thereof.

A cable 15 is connected with the platen 12 and extends upwardly about a sheave 16 (FIG. 1) and is wound for a number of turns about a drum 17 and thence passes over a sheave 18 and dead ends to a counterweight 19 operable in a well 20. The drum 17 is coupled to a gear speed increaser 21 which in turn is coupled through a clutch 22 and a second gear speed increaser 23 with an element 24 which may be a tachometer generator which produces a direct current at a voltage responsive to the actual speed of advance of the piston 10 as communicated through the cable 15 to the drum 17. The tachometer generator is a commercially available unit; I prefer to utilize a Jordan Controls model RF 1210.

Figure 3:
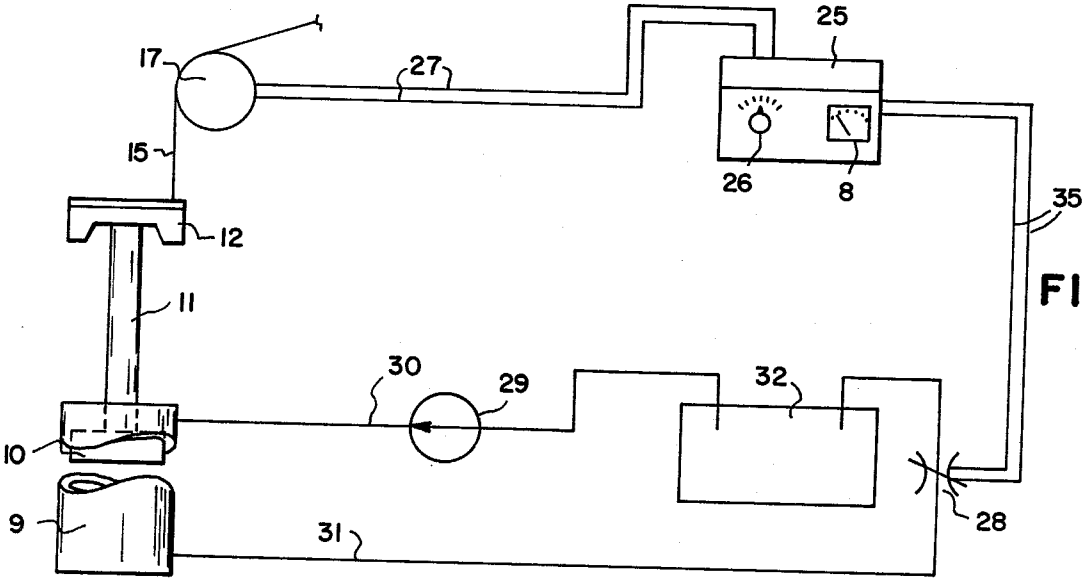
FIG. 3 is a diagram of the fluid control system.

Referring to FIGS. 1 and 3, there is shown a control unit 25 which is connected with a source of direct current and contains a control circuit settable by a knob 26 at a predetermined voltage consonant with downward movement or advance of the piston 10 at a desired speed, which voltage is shown on the dial 8. The voltage from the tachometer generator 24 is fed into the control unit 25 through conductors 27. The voltage set by the knob 26 and that introduced through the conductors 27 are balanced against each other, the differential between the two voltages opening or closing a servo flow control valve 28 with which the control unit 25 is connected by conductors 35. A pump 29 pumps hydraulic fluid through a pipe 30 into the upper end of the cylinder 9 above the piston 10. A return line 31 extends from the bottom of the cylinder 9 below the piston 10 to a hydraulic fluid reservoir 32. The servo flow control valve 28 controls the return flow of hydraulic fluid from the bottom of the cylinder 9 to the reservoir 32. Thus the differential between the two voltages in the control unit 25 opens or closes the servo flow control valve to alter the differential pressure on opposite ends of the piston 10 to correct any deviation in the speed of the piston from the desired speed. Control units such as the control unit 25 are made by various manufacturers and are commercially available.

Figure 4:
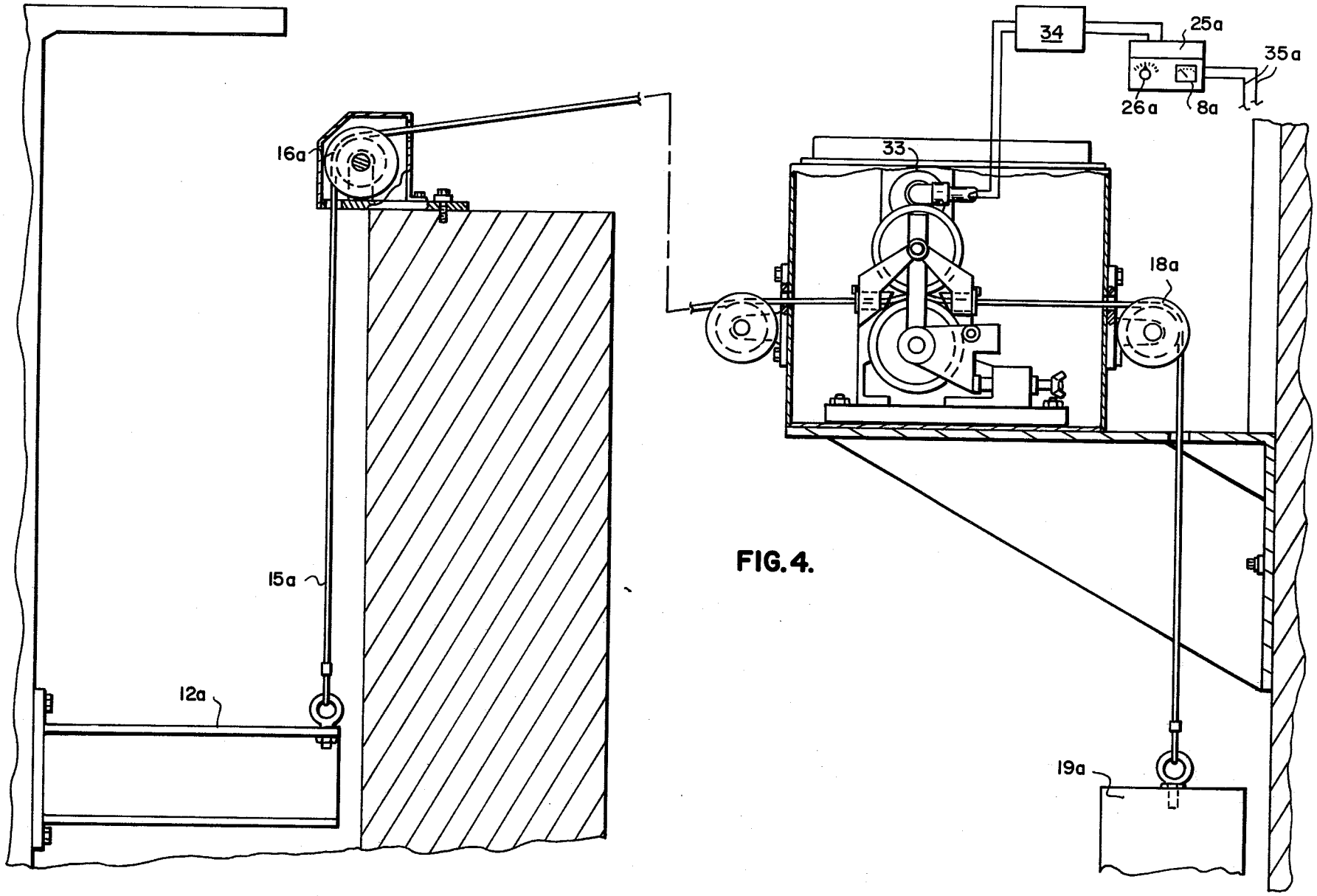
FIG. 4 is a view partly in elevation and partly in vertical cross-section of an alternative form of control mechanism.

Alternatively control mechanism as shown in FIG. 4 may be employed and accomplishes the same purpose. Elements shown in FIG. 4 which are analogous to those shown in FIG. 1 are identified by the same reference numerals as appear in FIG. 1, each with the letter a appended. FIG. 4 shows a pulse generator 33 actuated by movement of the cable 15a feeding into a frequency to direct current converter 34 which produces a direct current at a voltage responsive to the actual speed of advance of the piston 10 in the cylinder 9 which takes the place of the voltage supplied by the tachometer generator 24. All units employed are commercially available and known to those skilled in the art.

By the mechanism above described I control directly or automatically at a constant optimum speed the progressive formation of the castings, eliminating deviations heretofore caused by changes to oil viscosity, temperature and pressure and system leakage. I also eliminate the necessity for the continuous attendance of an operator.

While I have shown and described certain present preferred embodiments of the invention it is to be distinctly understood that the invention is not limited thereto but may be otherwise variously embodied within the scope of the following claims.

I claim:

1. Casting apparatus comprising means for feeding molten material, a mold receiving the molten material in which the molten material solidifies forming a casting advancing at a substantially constant speed through the mold, a cylinder, means including a piston operable in the cylinder ahead of the advancing casting limiting the speed of advance of the casting, means including a fluid pressure system for controlling the speed of advance of the piston in the cylinder by differential pressure on opposite ends of the piston, a control device having electric control means settable for the desired speed of advance of the piston, a signal device responsive to the actual speed of advance of the piston, said control device and said signal device respectively comprising direct current control and signal circuits at voltages which are balanced against each other with the aid of connections between the control device and the signal device, the differential between the two voltages being a measure of said differential pressure said fluid pressure system including a servo flow control valve which is responsive to said differential between the two voltages to correct any deviation in the speed of advance of the piston from the desired constant speed.

2. Casting apparatus comprising means for feeding molten material, a mold receiving the molten material in which the molten material solidifies forming a casting advancing at a substantially constant speed through the mold, a cylinder, means including a piston operable in the cylinder ahead of the advancing casting limiting the speed of advance of the casting, means including a fluid pressure system for controlling the speed of advance of the piston in the cylinder by differential pressure on opposite ends of the piston, a control device having electric control means settable for the desired speed of advance of the piston, a signal device responsive to the actual speed of advance of the piston, said control device comprising a direct current control circuit at a predetermined voltage consonant with the advance of the piston at said constant speed and the signal device comprising a pulse generator feeding into a frequency to direct current converter to produce direct current at a voltage responsive to the actual speed of advance of the piston, which voltages are balanced against each other with the aid of electrical connections between said control device and said signal device, the differential between the two voltages being a measure of said differential pressure, said fluid pressure system including a servo flow control valve which is responsive to said differential between the two voltages to correct any deviation in the speed of advance of the piston from the desired constant speed.

* * * * *